United States Patent [19]

Frantisek

[11] Patent Number: 4,617,809

[45] Date of Patent: Oct. 21, 1986

[54] FLOW PRESS, ESPECIALLY FLOW SAMMYING MACHINE, FOR THE PRODUCTION AND PROCESSING OF LEATHER

[76] Inventor: Flekac Frantisek, Graf-Staufenberg-Ring 102, D-6380 Bad Homburg vor der Höhe, Fed. Rep. of Germany

[21] Appl. No.: 517,519

[22] PCT Filed: Nov. 15, 1982

[86] PCT No.: PCT/DE82/00212

§ 371 Date: Jul. 13, 1983

§ 102(e) Date: Jul. 13, 1983

[87] PCT Pub. No.: WO83/01786

PCT Pub. Date: May 26, 1983

[30] Foreign Application Priority Data

Nov. 14, 1981 [DE] Fed. Rep. of Germany ..... 3145359

[51] Int. Cl.[4] ..... C14B 1/08; C14B 1/04

[52] U.S. Cl. ..... 69/44; 69/47

[58] Field of Search ..... 69/41, 42, 43, 44, 45, 69/47

[56] References Cited

U.S. PATENT DOCUMENTS

| | | | |
|---|---|---|---|
| 619,614 | 2/1899 | Quirin | 69/41 |
| 989,278 | 4/1911 | O'Brien | 69/42 |
| 1,075,887 | 10/1913 | Whitney | 69/42 |
| 1,131,756 | 3/1915 | Wayland | 69/42 X |
| 2,297,189 | 9/1942 | Ladner et al. | 69/34 |
| 2,330,271 | 9/1943 | Cutler | 69/43 |
| 2,958,989 | 11/1960 | Pendergast | 51/139 |
| 3,640,105 | 2/1972 | Richter et al. | 69/41 |
| 4,055,059 | 10/1977 | Dokoupil | 69/41 |

FOREIGN PATENT DOCUMENTS

| | | | |
|---|---|---|---|
| 2049649 | 5/1972 | Fed. Rep. of Germany | 69/42 |
| 575775 | 4/1924 | France | 69/43 |
| 1034781 | 7/1953 | France . | |
| 2167248 | 8/1973 | France . | |
| 2322201 | 3/1977 | France . | |
| 668566 | 3/1952 | United Kingdom | 69/41 |
| 777045 | 6/1957 | United Kingdom . | |
| 873667 | 7/1961 | United Kingdom . | |
| 936250 | 9/1963 | United Kingdom | 69/43 |

*Primary Examiner*—Wm. Carter Reynolds
*Attorney, Agent, or Firm*—Yount & Tarolli

[57] ABSTRACT

In flow presses for the production and processing of leather, especially in sammying (drying) machines, the need exists for a preliminary effective stretching and widening of the leather to prevent the forming of creases. In a flow press with a pair of pressing rolls (W1, W2), there is arranged for this purpose in the zone of the entrance wedge (EZ) of the rolls, a stretching device (ARV) acting transverse to the flow direction (P1) of the leather, which is adjustable between an open position (OST) permitting introduction of the leather, and a working position (AST) with stretching tools (RW1, RW2) acting on the leather. This permits a perfect introduction of the leather, with visual control and with possibilities of correction. The slight distance attainable between the end section (EA) of the stretching tool and the roll pressing zone (PRZ), especially with non-rotating plate-form stretching tools, favors the suppression of creases in the pressing process.

8 Claims, 6 Drawing Figures

FLOW PRESS, ESPECIALLY FLOW SAMMYING MACHINE, FOR THE PRODUCTION AND PROCESSING OF LEATHER

The invention concerns a flow press, especially a flow sammying machine for the production and processing of leather, with at least one pair of rolls under mutual pressure, the flow line of pieces of leather to be processed preferably being provided with at least one suction and/or conveyor belt. Such flow presses and especially sammying machines, are generally known, and are used for the pressing processes necessary in different stages of leather production and processing, especially those for removal of fluid from the leather. These work steps and the respective machines are of great importance, in their effectiveness and their capacity, to the quality of leather and, respectively, to the efficiency of the whole production process.

A sammying is generally necessary at least twice, in the leather production process, while special requirements are set, especially for the first sammying, as to the quality and water content of the leather. In any case, however, folds (creases) in the leather during the pressing process are to be prevented so far as possible, and also creases present before the pressing are to be removed, so far as possible. In known flow sammying machines, this stretching, which may have to be carried out repeatedly, has been carried out in a separate work step, and with corresponding separate devices, before the sammying. Also known in such sammying machines is the use of blade cylinders which press the leather to be sammied against the entrance-side conveyor or suction belt. These blade cylinders cause, essentially, just a more even lying of the leather against the entrance-side belt, but do not constitute a true stretching device. In any case, no substantial stretching and widening effect transverse to the flow direction, and thus no substantial reduction of creasing, is obtained in this way. In particular, the adhesive effect between suction or conveyor belts of the usual kind, on the one hand, and the leather pressed against them, on the other hand, opposes a relative movement between leather and belt transverse to the flow direction and thus an effective stretching and widening process.

The problem of the invention, therefore, is to provide a flow sammying machine which makes possible, without separate work steps, in the very same leather passage, a highly effective stretching and widening process, preceding the sammying. The solution of this problem, according to the invention, is distinguished, in a flow sammying machine of the kind mentioned, by at least one stretching device, arranged in the zone of the entrance wedge of the pair of rolls, acting at least partly transverse to the flow direction, which is designed to be adjustable between an open position allowing the introduction of the leather, and a working position with stretching tools acting on the leather.

Through such an arrangement of a stretching device, acting transverse to the flow direction of the leather, in the zone directly before the zone of the roll pressure, an intensive widening of the leather is obtained which, because of the slight distance of this stretching and widening zone before the subsequent flow pressing zone, is retained during the actual sammying and pressing process. The more or less strong contraction of the leather before entering the roll pressing zone, inevitable when the stretching device is located at a greater distance before the roll pressing zone is prevented thereby, and an outstanding freedom from creases is attained in the pressing process. At the same time, the adjustability of the stretching device between working position and open position makes possible an introduction of the leather, already loosely widened and free of coarse folds, into the work zone of the stretching device and the entrance zone of the rolls.

According to one preferred form of execution of the invention, the stretching device has, on at least one surface side of the leather, a stretching tool, at rest or moved opposite the flow movement, engaging, in the working position, in the entrance wedge of the pair of rolls. This engagement arrangement of the stretching tool in the entrance wedge of the rolls, makes possible an especially slight distance between the outlet of the stretching device and the entrance into the roll pressing zone. Even with leather with a stronger tendency to contraction and creasing, a largely fold-free pressing and sammying process can be obtained. It is especially advantageous, in this connection, according to one development of the invention, to have the open position of the stretching device be set back, opposite the flow direction, in relation to the working position. This makes possible, even with greater roll diameter, especially with a greater upper roll diameter, a relatively wide open position, such as that desirable for an ideal laying-in process, while, on the other hand, a deeper engagement of the stretching tool in the entrance wedge of the rolls is retained in the working position.

In principle, it is true, rotating cylindrical stretching tools may be considered for the stretching device which, on their working side, rotate opposite the flow direction of the leather. However, the inevitable diameter and height extent of such rotating stretching tools opposes the desired deep engagement in the entrance wedge of the rolls and thus makes impossible having only a slight distance between stretching tool and roll pressing zone. An important further development of the invention provides, therefore, that the stretching device have at least one plate-form stretching tool, of which the rear end section, seen in the flow direction, in the working position, is arranged within the entrance wedge of the rolls. Such a stretching tool permits a design with very slight thickness and height extent and in particular with end section tapering in cross section, which can thus engage, in the working position, in the entrance wedge, just before the roll pressing zone.

The stretching device may be provided with cooperating stretching tools on both surface sides of the leather, especially with indentation-type cooperating complementary stretching elements. A further development of the flow press according to the invention, especially good as to production cost and particularly advantageous in handling, is distinguished, however, by the fact that the stretching device has, on one surface side of the leather, an opposite support which can slide on the leather, and which is preferably soft-deformable and yielding to pressure, for at least one stretching tool arranged on the opposite surface side of the leather. Such an opposite support is preferably arranged on the under side of the leather, moving in a horizontal plane. The sliding surface quality of the opposite support, in relation to the leather, which is pressed by the stretching tool lying opposite, is important to the stretching and widening, because in this way, the necessary relative movement, especially taking place transverse to the flow direction, between leather and opposite support, is not impaired. For many cases of use or qualities of leather, a rigid opposite support with surface which can slide, is sufficient, while the stretching elements of the tool lying opposite, alone, through the friction connection with the leather surface or the compressibility of the leather, exert a sufficient stroking effect on the leather. This stroking effect may also, however, if desired, be supported and reinforced by the above-mentioned soft-deformable and pressure-yielding property of the opposite support.

Another important further development of the invention provides that a stretching tool opposite support of the kind mentioned is connected with a feed table for the leather to be processed or is designed, itself, as a feed table. This feed table is supported movable between a preparation and arranging position, placed forward, opposite the flow direction and an entrance position, placed behind, in the flow direction, engaging in an entrance wedge of the rolls. Such a design greatly facilitates and simplifies the feeding and laying-in process, by the operator or by an automatic feeding device, because the laying-in can be done in a relatively accessible position, favorable to the preparatory stretching of the leather, and under visual control.

The combining of feed table and stretching opposite support or lower tool means, in this connection, an advantageous simplification of construction and a considerable saving of space for the machine parts arranged in the entrance zone. In principle, however, such a feed-side table arrangement can also be used, independently of the presence of a stretching tool, and thus in connection with other flow presses for leather production and processing. The subject of the invention extends, therefore, to this independent use of the feed table arrangement. In this connection, there may also be provided additionally, with particular advantage, a feed conveyor belt for the leather pieces to be processed in the zone of the preparation and arranging position of the feed table, which facilitates tending and makes possible an early arranging of the next piece of leather, in each case, before the return of the feed table to its original position, that is, an increased work speed.

Other features and advantages of the invention will be explained from the examples of execution represented schematically in the drawings, wherein.

Figure 1:
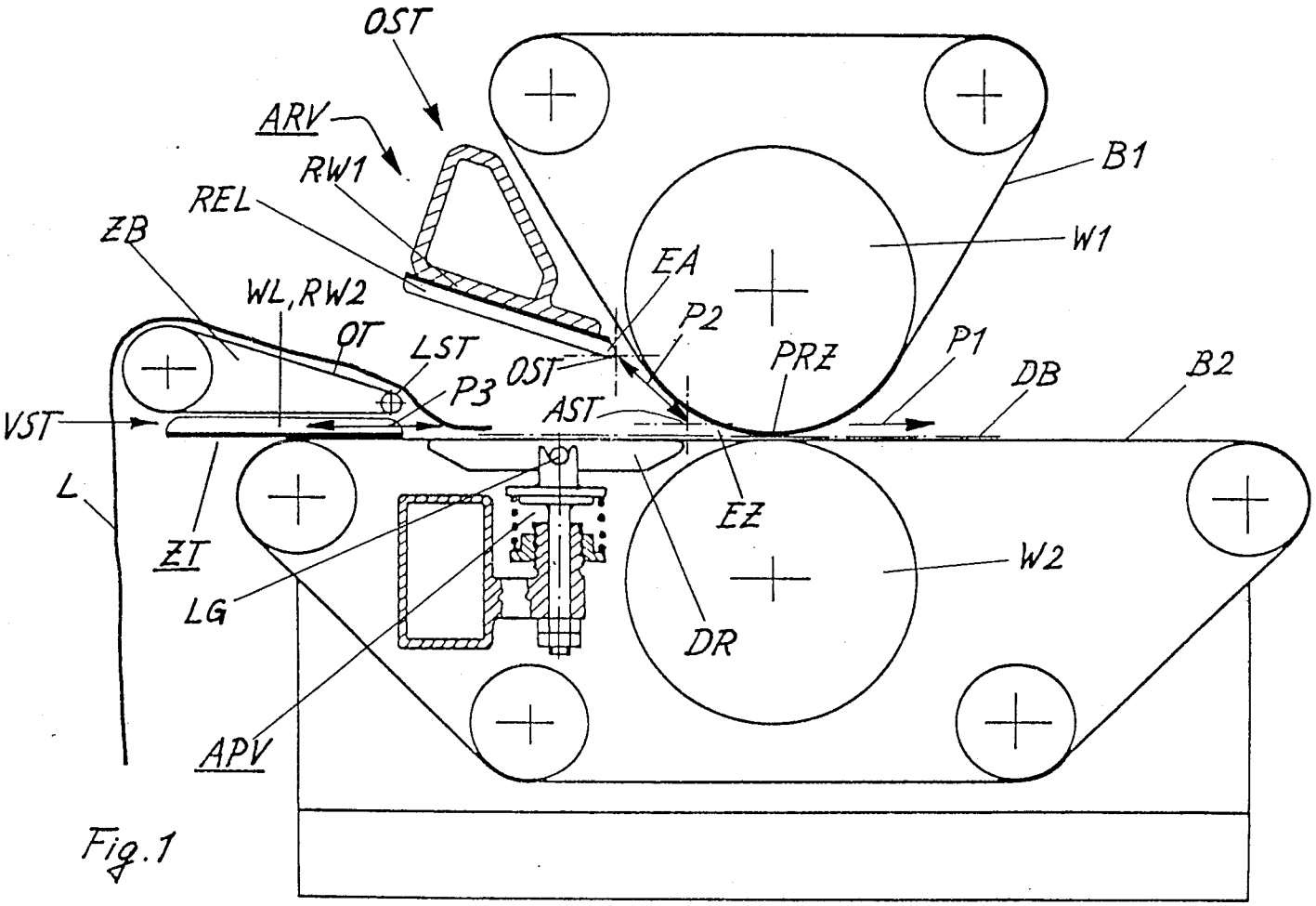
FIG. 1 shows a flow sammying machine with integrated stretching device, in a schematic vertical section transverse to the arrangement of the rolls, with stretching device in the open position.
Figure 4:
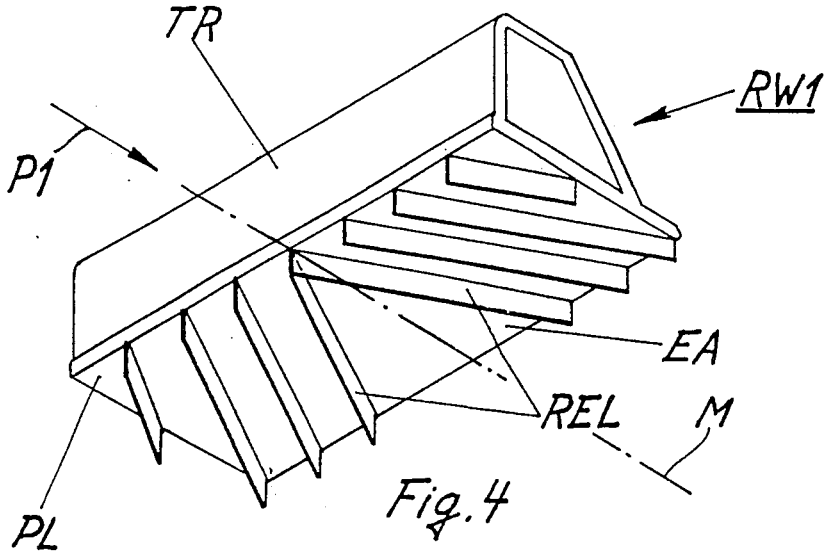
FIG. 4 is a perspective view of the working side of a plate-form stretching tool of FIG. 1.
Figure 5:
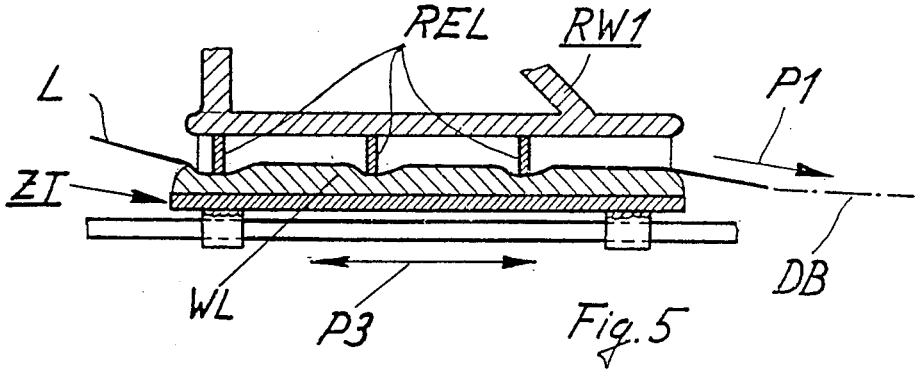
FIG. 5 shows a stretching opposite support with pressure-yielding cushioning, in cross section, in the working position with leather laid out and stretching tool of FIG. 1 in action.
Figure 6:
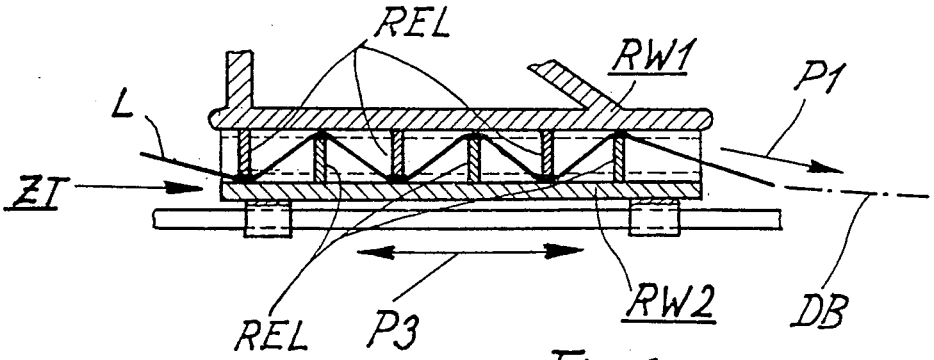
FIG. 6 is a partial cross section of a stretching device as shown in FIG. 1 with two stretching tools, acting opposite and complementing each other.

FIGS. 4, 5, and 6 depict two different embodiments of the stretching device, either of which is usable with the apparatus of FIG. 1.

Figure 2:
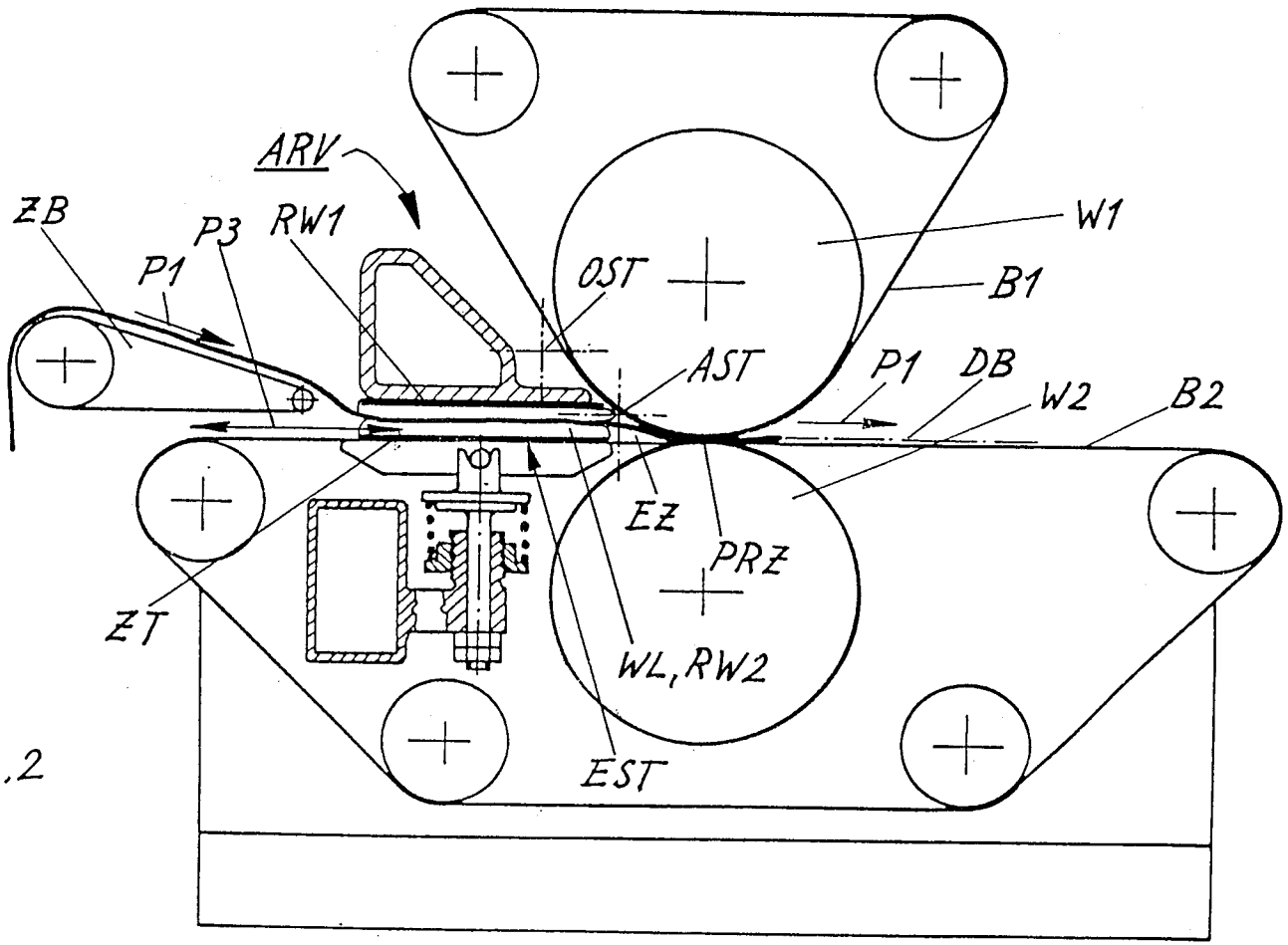
FIG. 2 is a representation according to FIG. 1, but with stretching device in the working position.

The flow press shown in FIGS. 1 and 2 is a sammying machine with two rolls, W1 and W2, supported axis-parallel, and under vertical mutual pressure, which, within the flow line DB (indicated in dot-and-dash line) of the pieces of leather L to be processed, forms a pressing or squeezing zone PRZ. On the side of each of the two rolls W1 and Ww there are conducted through the pressing zone PRZ suction or conveyor belts B1 and B2. These are the usual felt strips, revolving endlessly and conducted over the corresponding turning and drive rolls. The flow direction of the leather, in which the rolls W1 and W2 are driven by the respective belts B1 and B2 of an assembly of the usual kind, not shown, is indicated by the arrow P1.

The rolls W1, W2, with the respective suction or conveyor belts, form an entrance wedge EZ, into which, in each case, the front edge of the piece of leather to be processed is introduced, to be caught by the belts B1, B2, running together and advanced into or through the pressing zone PRZ. Before the entrance EZ is connected a stretching device ARV, which consists mainly of a stretching tool RW1, arranged above the flow path DB, and an opposite support WL, arranged below the flow path, for the stretching tool. The stretching device ARV also may include a second stretching tool RW2, and also a pressing device APV. The stretching tool RW1 extends, in one piece or in sections lying side by side, over the working width of the roll arrangement and is designed adjustable, by guides and drive means, ordinary and not shown in detail, according to the double arrow P2, between an open position OST according to FIG. 1 and a working position AST according to FIG. 2. In the open position, the entrance zone of the stretching device ARV and the entrance wedge of the roll arrangement are freed for laying in the front section of a piece of leather or for its entrance into the pressing zone PRZ. The open position is set back, in relation to the working position, opposite the flow direction, according to the arrow P1, so that, on the one hand, a sufficient height position and a large entrance opening is available for the introduction of the leather, while, on the other hand, as can been seen from FIG. 2, the end section EA of the stretching tool RW1 can engage deeply into the entrance wedge EZ. This gives, as already mentioned in the introduction, the advantage of a slight distance between the end of the stretching device and the entrance into the pressing zone PRZ of the pair of rolls.

In the working position AST of the stretching tool RW1, the opposite support WL is pressed upward by a pressing device APV arranged below the entrance section of the belt B2; that is, against the leather in the stretching device and also against the stretching elements of the stretching tool lying above. This working pressure is provided by the pressing device through a pressure plate DR, which to compensate for any inaccuracy of position of the stretching tool and variation of thickness of the leather, is provided with a swinging support LG. The same arrangement may be used also in the instance where, instead of the underlying opposite support WL, a second stretching tool RW2, with stretching elements complementary to the stretching tool RW11 lying opposite, is provided. The structure of such stretching tools and opposite supports will be represented in detail farther on.

In the execution according to FIGS. 1 and 2, the opposite support WL or the correspondingly arranged lower stretching tool RW2 is designed as a feed table ZT, movable parallel to the flow path DB according to arrow P3 between a preparation and arranging position VST (FIG. 1) and an entrance position EST (FIG. 2). Also, in the zone of the position VST of the feed table and above same, a smaller, endless revolving feed belt ZB, with corresponding guiding and turning rolls, as well as a drive, not shown, is provided. When a piece of leather to be processed is laid on, this feed belt receives by its inclined upper section OT, falling in the flow direction, the front section of the piece of leather to be coarsely widened first, and carries the latter in the flow direction until its front edge arrives in the zone before the entrance wedge EZ on the entrance-side section of the belt B2 (FIG. 1). Then the feed table is pushed forward from its position VST below the feed belt ZB, in the flow direction, synchronously with the belt B2, until its assumes its entrance position EST (FIG. 2). Meanwhile, the feed table carries forward with it the front section of the leather which lies on the opposite support WL or the lower stretching tool, as the case may be. On reaching the entrance position, the front edge of the piece of leather arrives in the entrance wedge EZ, and into the entrance zone of the pressing zone PRZ of the pair of rolls. Then the leather is caught by the belts B1, B2, running together, and drawn into the pressing zone. At the same time, the upper stretching tool RW1 is lowered, and moved forward, according to the arrow P2, from its open position OST into the working position AST. With this, the pressing of the leather is effected, between the upper stretching tool RW1 and the opposite bearing WL beneath, or the correspondingly arranged stretching tool RW2. The leather is now drawn steadily by the stretching device ARV, while the successive sections of leather arrive, uniformly and already loosely widened, over the upper section OT and the discharge point LST of the feed belt, into the entrance zone of the stretching device.

Figure 3:
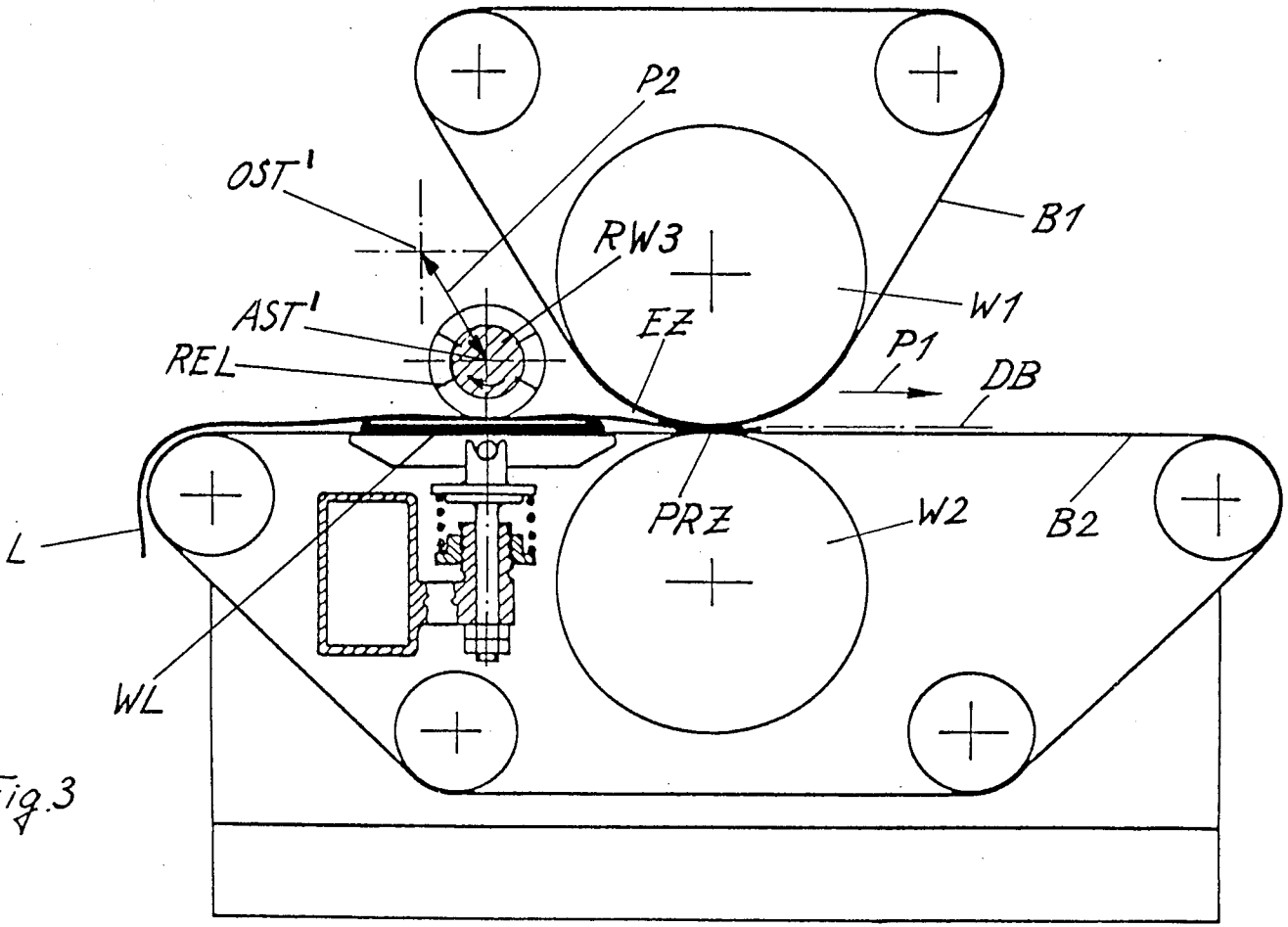
FIG. 3 shows a flow sammying machine with integrated stretching device, with a modified design of a stretching tool.

The stretching and sammying machine according to FIG. 3 differs from the design explained above (aside from the elimination of a feed belt for the load of leather), by the use of a rotating stretching tool RW3 instead of a plate-form stretching tool, at rest, against the upper side of the leather. The stretching tool RW3, designed as a cylinder and provided with strip-form stretching elements REL, rotates, at its under side, opposite to the flow direction P1, and exerts, through suitably oblique positioning of the strip-form stretching elements, a corresponding stroking effect on the leather, directed transverse to the flow direction and parallel with the plane of the leather. Despite the somewhat important advantage of the greater relative stroking speed between the stretching elements and the leather surface, such a design is subject to the limitation that on the under side of the leather no complementary stretching tool, acting on the leather by means of corrugations, but rather, only a smooth opposite support WL can be used.

The stretching tool RW3, as in the previous form of execution, is movable, according to the arrow P2, between an open position OST' and a working position AST'. In the open position, as in the previous design, the perfect entrance of the leather into the zone of action of the stretching device and the introduction of the front edge of the leather into the entrance wedge EZ and the pressing zone PRZ can be checked. In the opened entrance zone, moreover, an intervention is possible for the correction of any folds formed.

Contrary to the previous form of execution, with the use of a roll-form stretching tool RW3, according to FIG. 3, an equivalent shaping of the transition zone between stretching device and roll pressing zone cannot be attained. As appears from FIG. 3, even a relatively small roll diameter of the stretching tool RW3 does not permit near approach comparable to the design according to FIGS. 1 and 2, between the outlet zone of the stretching device and the entrance zone of the pressing zone, because the roll diameter sets limits to the engaging of the stretching tool into the entrance wedge. The design with stationary, and in particular plate-form stretching tool, tapering to a point toward its rear edge, is therefore generally more advantageous.

From FIG. 4 can be seen in detail the structure of the upper stretching tool. Below the hollow profiled support body TR is formed a plate PL, of which the surface extent substantially determines the stretching zone, and of which the rear end section EA engages, according to FIG. 2, into the entrance wedge EZ of the pair of rolls. Against the under side of the plate PL are set strip-form or blade-form stretching elements REL, arranged divergent in the flow direction P1, which run obliquely outward in opposite directions on both sides of the middle M of the conveyor path. These stretching elements engage against the leather with friction fitting and because of the pressure deformability of the leather, lying on a solid, smooth opposite support surface, or in combination with a cushion-like opposite support, also, form fitting, with corresponding corrugations. With the sliding movement of the leather in relation to the free lengthwise edges of the stretching elements, there is given the desired stretching and widening effect, transverse to the flow direction, and parallel to the plane of the leather.

The above-mentioned corrugation of the leather, with partly form-fitting attack of the stretching elements against the leather, is shown in FIG. 5 in a schematic vertical section, of a cushion-type opposite support WL (in combination with a feed table ZT which can be pushed along). The same applies to stretching tools RW1 and RW2, arranged one above the other, with stretching elements REL arranged complementary, and correspondingly greater corrugation, as well as the stretching effect as represented in FIG. 6. In all cases, the result is that the elements of the stretching device coming in contact with the leather have a surface quality which can slide sufficiently in relation to the leather, so that the relative movement necessary for the stretching process is not too greatly hindered. In the examples of execution shown, this can be attained directly, because there is provided a constructive separation between the pressing and suction elements coming in contact with the leather, on the one hand, and the stretching elements, moved in relation to the leather, on the other hand.

What is claimed is:

1. Apparatus for treating leather, comprising at least one opposed pair of rolls between which the leather to be treated is guided, means for moving the leather along a flow path from a location spaced apart from said rolls to said rolls, stretching means for stretching the leather prior to its being guided between said rolls and comprising a first stretching tool disposed on one surface side of the leather and operable to stretchably engage the leather at a location in the entrance wedge of said rolls at a distance from said rolls whereby the stretched leather does not contract prior to entering between said rolls, and a feed table for feeding the leather to the rolls, said feed table being movable between a first preparation and arranging position spaced apart from said rolls in a direction opposite the flow path of the leather and a second entrance position in the entrance wedge of said rolls, said feed table having support means for said first stretching tool and disposed on the opposite surface side of the leather from said first stretching tool.

2. Apparatus as defined in claim 1 further comprising feed conveyor belt means adjacent said first position of said feed table.

3. Apparatus as defined in claim 2 wherein said feed table when in its first position is disposed at least partially below the discharge point of said feed conveyor belt means.

4. Apparatus as defined in claim 1 wherein said first stretching tool comprises a plate-form stretching tool having at least one pair of stretching elements disposed divergent from the flow path of the leather whereby the leather is stretched at least partially in a direction transverse to the flow path of the leather, said plate-form stretching tool having a first end disposed within the entrance wedge of said rolls.

5. Apparatus as defined in claim 4 further comprising a second stretching tool disposed on said support means on the opposite surface side of the leather from said first stretching tool, said second stretching tool including at least one pair of stretching elements complementary to said stretching elements of said first stretching tool.

6. Apparatus as defined in claim 1 wherein said stretching means further comprises support means for said first stretching tool disposed on the opposite surface side of the leather from said first stretching tool and slidably engaging the leather.

7. Apparatus as defined in claim 6 wherein said support means is resilient.

8. Apparatus for treating leather, comprising at least one opposed pair of rolls between which the leather to be treated is guided, means for moving the leather along a flow path from a location spaced apart from said rolls to said rolls, and stretching means for stretching the leather prior to its being guided between said rolls, said stretching means being movable between a first open position spaced apart from said rolls to allow an initial guiding of the leather into said rolls, and a second working position in the entrance wedge of said pair of rolls, said first position of said stretching means being spaced apart from said second position in a direction opposite to the flow path of the leather, said stretching means comprising a rotating stretching tool adapted to rotatably engage the leather in a direction opposite to the direction of the flow path of the leather, said rotating stretching tool having a plurality of stretching elements disposed divergent from the flow path of the leather whereby the leather is stretched at least partially in a direction transverse to the flow path of the leather, and a feed table for feeding the leather to the rolls, said feed table being movable between a first preparation and arranging position spaced apart from said rolls in a direction opposite the flow path of the leather and a second entrance position in the entrance wedge of said rolls, said feed table having support means thereon for said first stretching tool disposed on the opposite surface side of the leather from said first stretching tool.

* * * * *